US007363902B2

(12) United States Patent
Ushijima et al.

(10) Patent No.: US 7,363,902 B2
(45) Date of Patent: Apr. 29, 2008

(54) ENGINE OVERALL HEIGHT REDUCTION

(75) Inventors: Kenshi Ushijima, Kamakura (JP); Shunichi Aoyama, Yokosuka (JP); Katsuya Moteki, Tokyo (JP); Naoki Takahashi, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 104 days.

(21) Appl. No.: 11/314,080

(22) Filed: Dec. 22, 2005

(65) Prior Publication Data

US 2006/0157016 A1 Jul. 20, 2006

(30) Foreign Application Priority Data

Dec. 28, 2004 (JP) ..... 2004-379447

(51) Int. Cl.
*F02B 75/06* (2006.01)

(52) U.S. Cl. ..... 123/192.2; 123/193.2

(58) Field of Classification Search ..... 123/192.2, 123/192.1, 197.1, 197.4, 48 B, 78 E, 78 F, 123/193.2

See application file for complete search history.

(56) References Cited

U.S. PATENT DOCUMENTS 3,403,605 A * 10/1968 Schmidt ..... 92/187
4,016,850 A * 4/1977 Bloemers ..... 123/193.2
4,570,586 A * 2/1986 Roe ..... 123/192.2
6,505,582 B2 1/2003 Moteki et al.
6,715,376 B2 * 4/2004 Hojyo et al. ..... 74/414
6,945,213 B2 * 9/2005 Kawakubo et al. ..... 123/195 R
7,086,368 B2 * 8/2006 Endoh et al. ..... 123/193.6
7,117,838 B2 * 10/2006 Aoyama et al. ..... 123/197.1
7,159,559 B2 * 1/2007 Iwasaki et al. ..... 123/197.3

FOREIGN PATENT DOCUMENTS

JP 7-107370 A 11/1995
JP 10-18854 A 1/1998
JP 11-343802 A 12/1999
JP 2005-147068 A 6/2005

* cited by examiner

*Primary Examiner*—Stephen K. Cronin
*Assistant Examiner*—Hyder Ali
(74) *Attorney, Agent, or Firm*—Foley & Lardner LLP

(57) ABSTRACT

An internal combustion engine includes a piston (2) and a crankshaft (33). The crankshaft (33) includes: a journal (33A) as a rotation center; a crank pin (33B) that is located eccentrically with respect to the journal (33A) and rotates integrally with the journal (33A), the crank pin (33*b*) connecting the piston (2) to the crankshaft (33); and a counter weight (33C) that is located eccentrically with respect to the journal (33A) in a direction opposite to the crank pin (33) and rotates uniformly with the journal (33A). A cutout (11) through which the counter weight (33C) passes is formed in a wall (1) of a cylinder bore that accommodates the piston (2) so as to be free to move reciprocally along the wall (1). As a result, the bottom dead center position of the piston can be lowered, and the overall height of the engine can be decreased.

11 Claims, 11 Drawing Sheets

ENGINE OVERALL HEIGHT REDUCTION

FIELD OF THE INVENTION

This invention relates to reduction of the height of an internal combustion engine.

BACKGROUND OF THE INVENTION

JP 11-343802 A, published by the Japan Patent Office in 1999, discloses an internal combustion engine in which crankshaft counter weights are disposed on an outer side of a cylinder bore. By disposing the counter weights in this manner, the counter weights will not interfere with a piston. It is thus possible to shorten the distance between a piston pin and the crankshaft, and to reduce the height of the internal combustion engine.

SUMMARY OF THE INVENTION

In order to dispose counter weights on an outer side of a cylinder bore, the axial distance from a connecting rod connecting part of a crankshaft to the counter weight must be set larger than the radius of the cylinder bore. However, when the distance from the connecting rod connection part to the counter weight becomes large, a bending force acting on the crankshaft increases when an engine rotates at high speed. This is not a structurally preferable operating environment.

It is therefore an object of this invention to reduce the height of an internal combustion engine without increasing the distance from a connecting rod connection part to a counter weight.

In order to achieve the above object, this invention provides an internal combustion engine which comprises a piston, a crankshaft connected to the piston and comprising a journal as a rotation center, a crank pin located eccentrically with respect to the journal and rotating together with the journal, the piston being connected to the crankshaft via the crank pin, and a counter weight located eccentrically with respect to the journal in a direction opposite to the crank pin and rotating together with the journal, and a cylinder bore accommodating the piston such that the piston is free to reciprocate along a wall of the cylinder bore, the wall of the cylinder bore having a first cutout that allows a part of the counter weight to pass-through when the piston reciprocates in the cylinder bore.

The details as well as other features and advantages of this invention are set forth in the remainder of the specification and are shown in the accompanying drawings.

DESCRIPTION OF THE PREFERRED EMBODIMENTS

Figure 1:
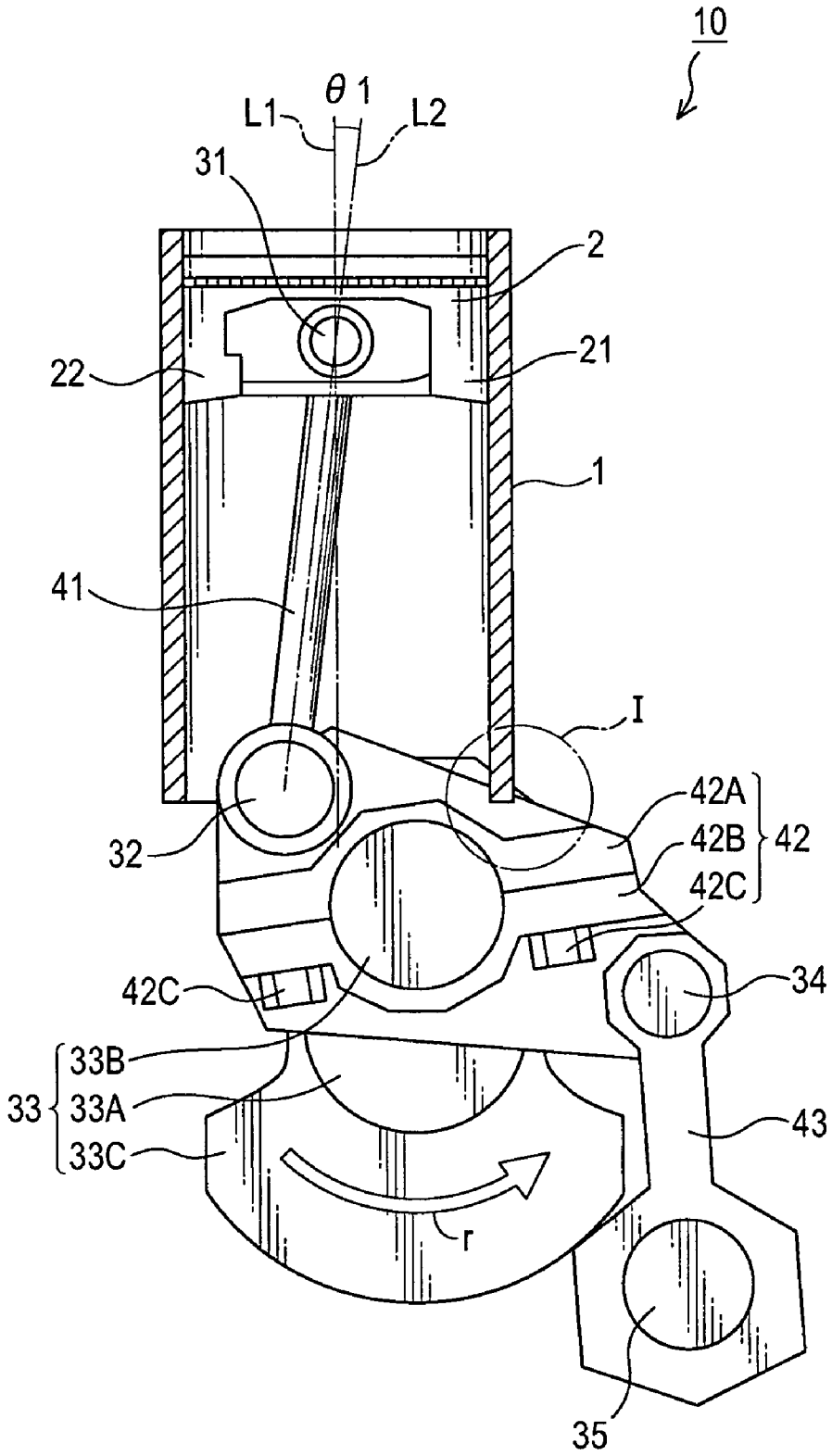
FIG. 1 is a front elevation of a piston and related members at top dead center of a multiple link internal combustion engine to which this invention is applied.

Referring to FIG. 1 of the drawings, an internal combustion engine 10 is a multiple link engine in which a piston 2 and a crankshaft 33 are connected by two links, an upper link 41 and a lower link 42. The structure of a multiple link engine is known in U.S. Pat. No. 6,505,582 B, and is explained simply below.

Under a combustion pressure, the piston 2 moves reciprocally within a cylinder liner 1 inserted into a cylinder block. The cylinder liner 1 corresponds to a wall of a cylinder bore in the Claims.

An upper end of the upper link 41 connects to the piston 2 through a piston pin 31, and a lower end of the upper link 41 connects to a lower link 42 through a first connecting pin 32.

The lower link 42 includes a first member 42A and a second member 42B. The first member 42A and the second member 42B are tightened securely together by bolts 42C. A crank pin 33B of the crankshaft 33 is disposed in a center connection hole formed by the first member 42A and the second member 42B. The lower link 42 rotates about the crank pin 33B.

Figure 2:
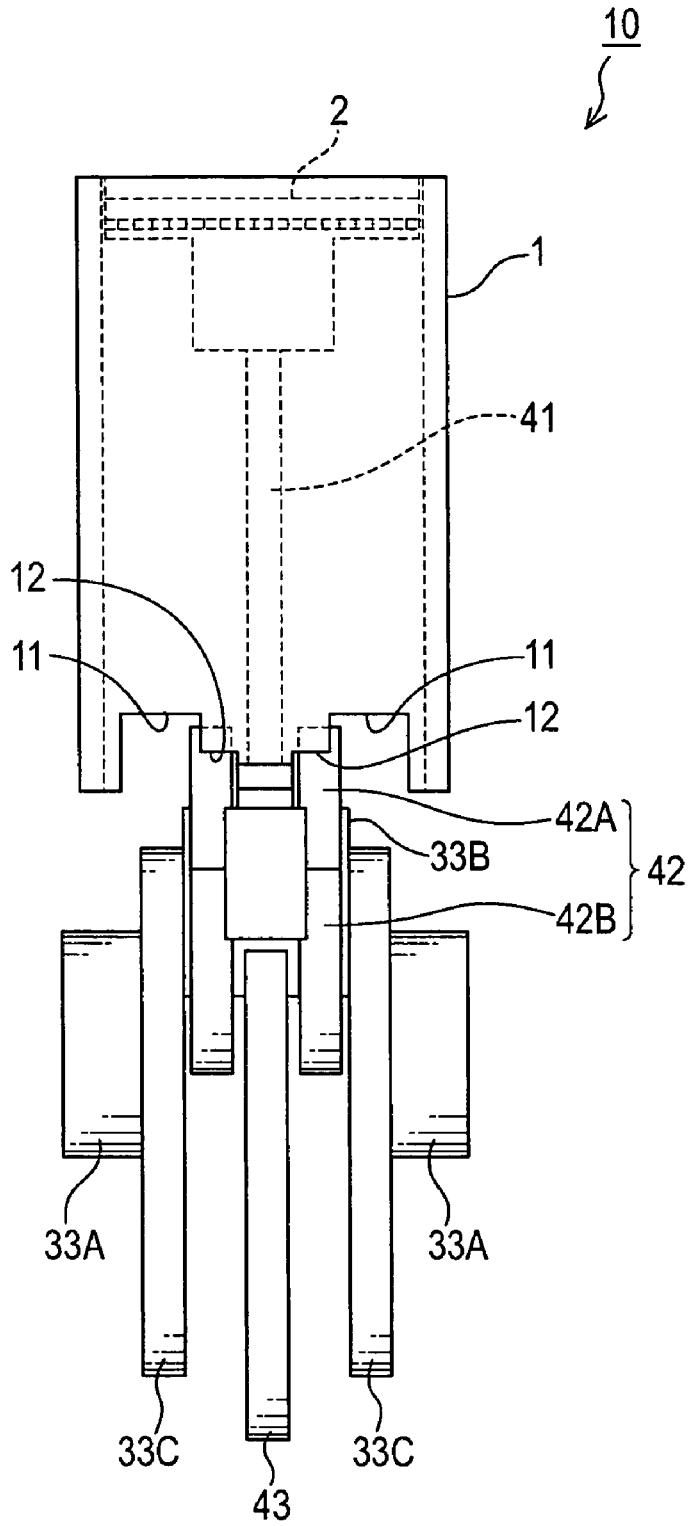
FIG. 2 is a side elevation of the piston and the related members as viewed from the right side of FIG. 1.

Referring to FIG. 2, an outer end of the first member 42A is divided into two branches, forming a U-shape, and connects on an inner side thereof to the upper link 41. A first connecting pin 32 thus passes through the upper link 41 and latches onto the two branches of the first member 42A. The first member 42A corresponds to a two-branch member in the Claims. An outer end of the second member 42B is divided into two branches, forming a U-shape, and connects on an inner side thereof to a control link 43. A second connecting pin 34 thus passes through the control link 43 and latches the control link 43 onto the two branches of the second member 42B.

Figure 4:
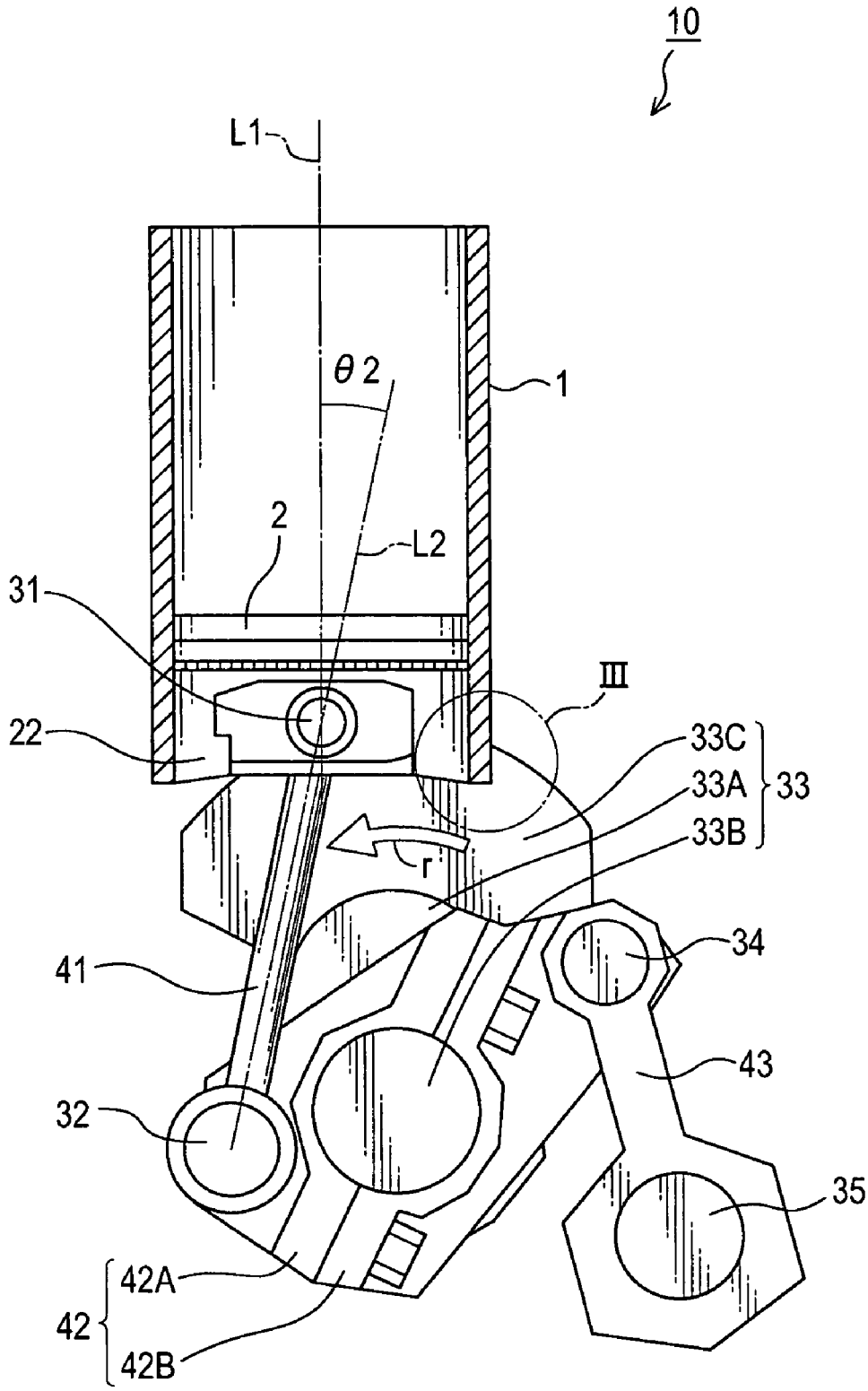
FIG. 4 is similar to FIG. 1, but shows a state where the piston is at bottom dead center.

Referring to FIG. 2, the crankshaft 33 includes one pair of journals 33A, the crank pin 33B, and one pair of counter weights 33C for one cylinder liner 1. The crankshaft 33 rotates about the journals 33A. Referring to FIG. 1, the rotation center of the crankshaft 33 is disposed on a side opposite to the first connecting pin 32, sandwiching a cylinder center axis L1. Referring to FIG. 4, the positions of the journals 33A are determined in advance so that the rotating counter weights 33C do not collide with a left side wall of the cylinder liner 1. The crank pin 33B joins the one pair of counter weights 33C together. Again referring to FIG. 1, the crank pin 33B is decentered from the journals 33A by a fixed amount. The piston 2 moves reciprocally in an inner part of the cylinder liner 1, through the lower link 42, when the crankshaft 33 rotates.

The control link 43 is connected to a control shaft 35 so as to be free to rock. Further, the control link 43 is connected to the second member 42B of the lower link 42 by the second connecting pin 34 so as to be free to rotate. The control link 43 functions to regulate the movement of the lower link 42 and to control the top dead center position of the piston 2.

The piston 2 and the crankshaft 33 are connected through two links, the upper link 41 and the lower link 42, in the multiple link engines 10. Accordingly, the distance from the piston 2 to the crankshaft 33 increases, and thus the engine height tends to become large. Shortening the distance from the piston 2 to the crankshaft 33 by shortening the upper link 41 may be conceived of in order to reduce the engine height. However, the bottom dead center position of the piston 2 moves downward when the upper link 41 is shortened, and there is a fear that the counter weights 33C will interfere with the piston 2. Furthermore, it is also necessary to extend the wall of the cylinder liner 1 downward to be capable of guiding the movement of the piston 2, whose bottom dead center position has moved downward. However, there is a fear that the counter weights 33C or the lower link 42 will interfere with the extended cylinder liner 1.

Description will be given below on this point.

Figure 3:
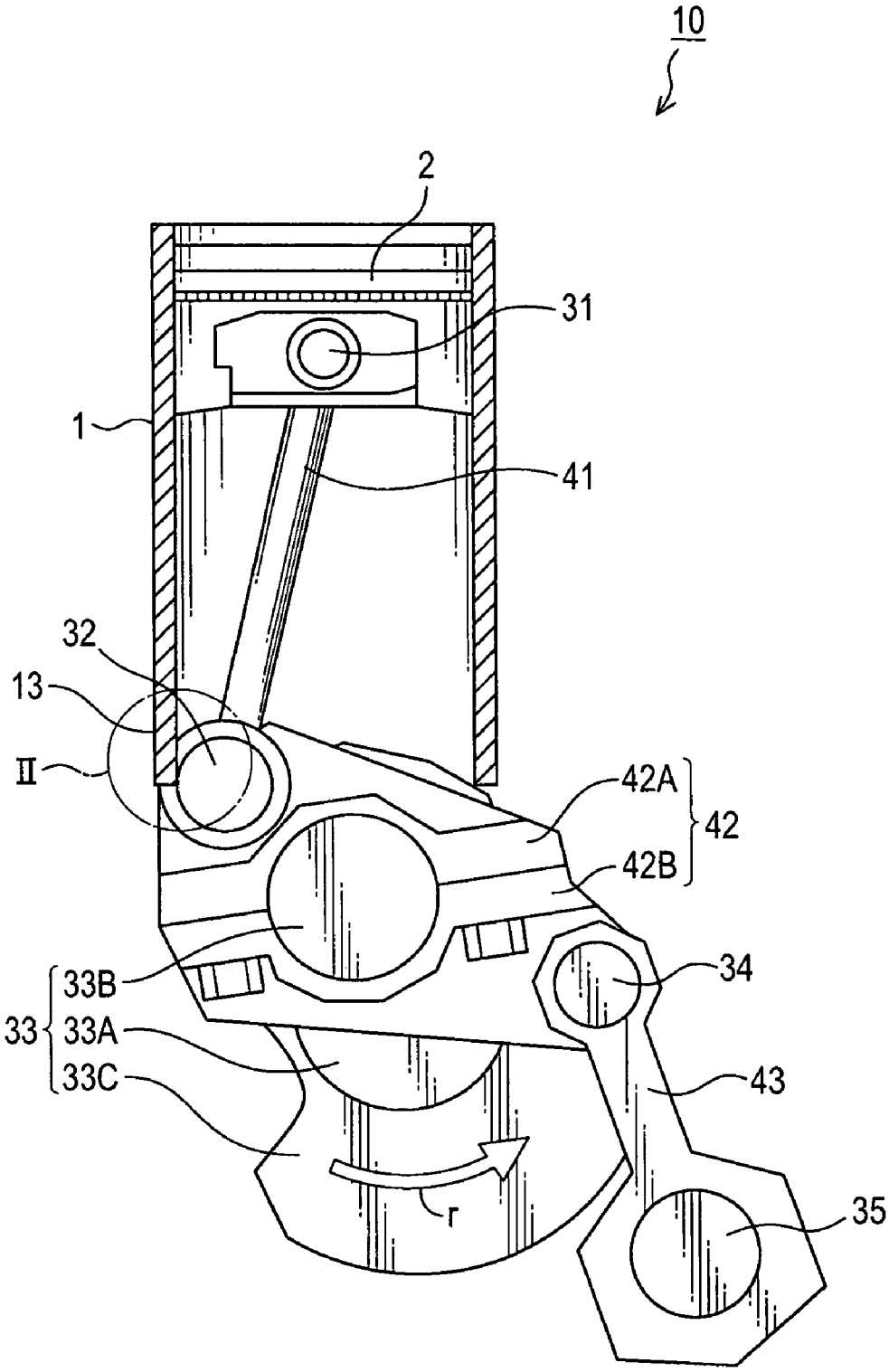
FIG. 3 is similar to FIG. 1, but shows a state after the piston has passed through the top dead center.

In the multiple link engine 10, the piston 2 moves from the top dead center position shown in FIG. 1 to the state of FIG. 3 when the crankshaft 33 rotates in the direction of an arrow r, and once again returns to the top dead center position shown in FIG. 1 after passing through the bottom dead center position shown in FIG. 4.

When the cylinder liner 1 is extended downward and the piston 2 is in the top dead center position, there is a fear that the lower link 42 will interfere with the cylinder liner 1 in a part enclosed by a circle I in FIG. 1.

Further, when the piston 2 is in a position slightly below top dead center, there is a fear that the lower link 42 will interfere with the cylinder liner 1 in a part surrounded by a circle II in FIG. 3.

In addition, when the piston 2 is in the bottom dead center position, there is a fear that the counter weights 33C will interfere with the cylinder liner 1 in a part surrounded by a circle III in FIG. 4.

Figure 7:
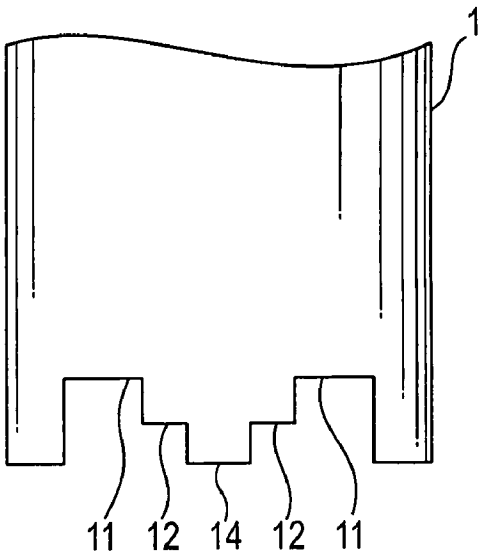
FIG. 7 is a side elevation of main part of the cylinder liner as viewed from the right side of FIG. 1.
Figure 6:
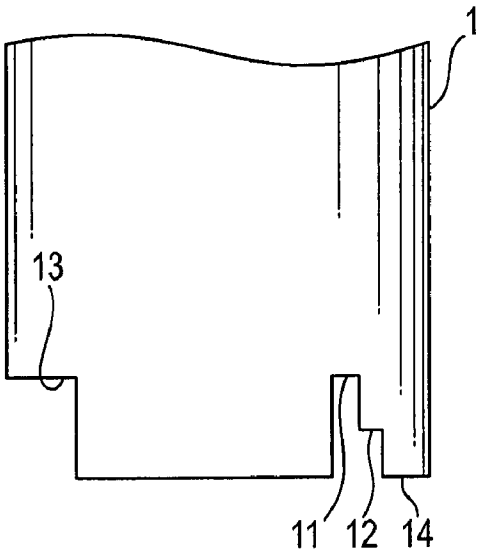
FIG. 6 is a front elevation of main part of the cylinder liner as viewed from the same direction as in FIG. 1.
Figure 13:
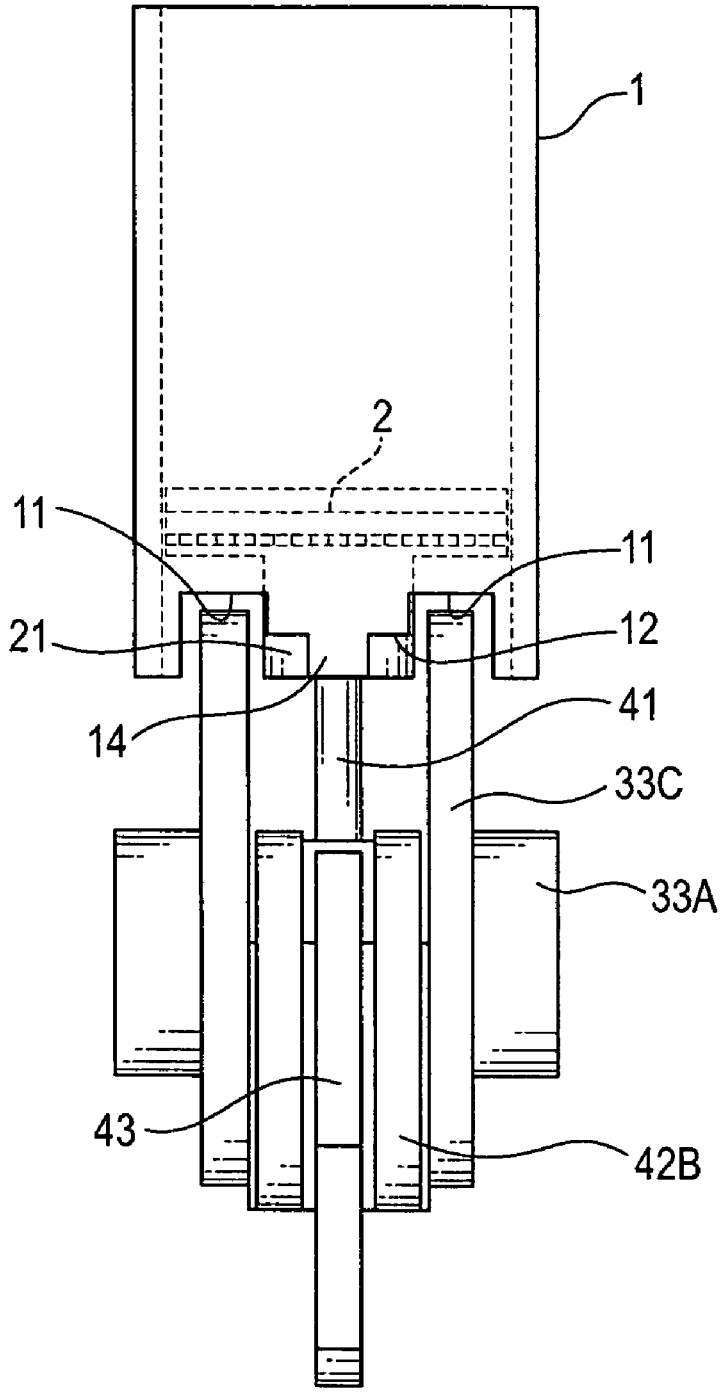
FIG. 13 is a side elevation of the piston and the related members as seen from the right side of FIG. 4.

Referring to FIGS. 6 and 7, a part of the right side wall of the cylinder liner 1 of FIG. 1 is cutout in the present invention, forming counter weight pass-through parts 11. The counter weight pass-through part 11 corresponds to a first cutout in the Claims. By thus forming the counter weight pass-through parts 11, the counter weights 33C will pass-through the counter weight pass-through parts 11 as shown in FIG. 13 and not interfere with the cylinder liner 1, even when the piston 2 is at bottom dead center.

Referring to FIGS. 6 and 7, a part of the right side wall of the cylinder liner 1 is further cutout, forming a lower link pass-through parts 12. The lower link pass-through part 12 corresponds to a second cutout in the Claims. By thus forming the lower link pass-through parts 12, the lower link 42 will pass-through the lower link pass-through parts 12 as shown in FIG. 2 and not interfere with the cylinder liner 1, even when the piston 2 is in the top dead center position.

Figure 5:
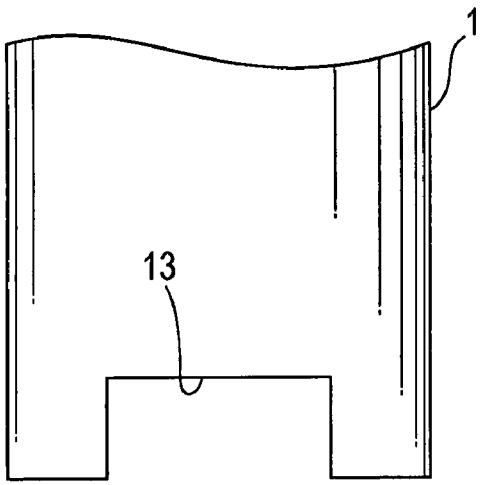
FIG. 5 is a side elevation of main part of a cylinder liner according to this invention as viewed from the left side of FIG. 1.
Figure 11:
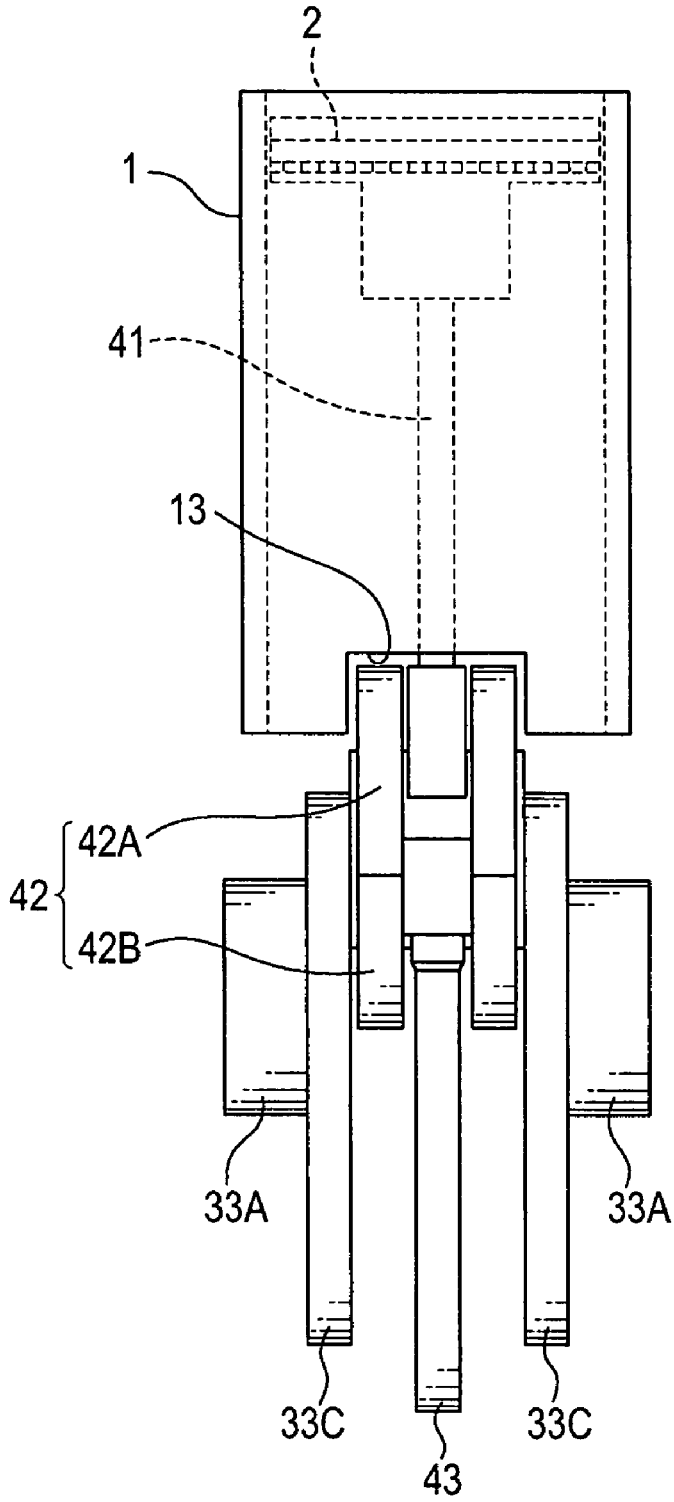
FIG. 11 is a side elevation of the piston and the related members as seen from the left side of FIG. 3.

Referring to FIGS. 5 and 6, a part of the left side wall of the cylinder liner 1 of FIG. 1 is cutout, forming a lower link pass-through part 13. The lower link pass-through part 13 corresponds to a third cutout in the Claims. By forming the lower link pass-through part 13, the lower link 42 will pass-through the lower link pass-through part 13 as shown in FIG. 11 and not interfere with the cylinder liner 1, even when the piston 2 is in a position slightly lower than top dead center.

It should be noted that the rotation center of the crankshaft 33 is positioned on the right side of FIG. 1 with respect to the cylinder center axis L1, and the counter weights 33C will not collide with the left side wall of the cylinder liner 1 of FIG. 1, as described above. It is therefore not necessary to form a cutout in order to avoid collisions with the counter weights 33C in the vicinity of the lower link pass-through part 13 as shown in FIG. 5.

Further, with the multiple link engine 10, an angle θ1 formed by the cylinder center axis L1 and a center axis L2 of the upper link 41 at top dead center as shown in FIG. 1 can be made smaller than an angle θ2 formed by the cylinder center axis L1 and the center axis L2 of the upper link 41 at the piston bottom dead center shown in FIG. 4. Provided that the angle θ1 can thus be made smaller than the angle θ2, a thrust force acting on the piston 2 in the vicinity of top dead center where pressure in the cylinder is large can be made smaller, and a piston skirt of the piston 2 can be made smaller.

Figure 10:
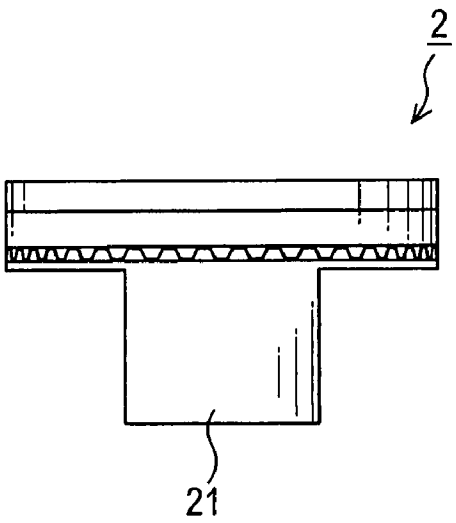
FIG. 10 is a side elevation of the piston as viewed from the right side of FIG. 1.
Figure 9:
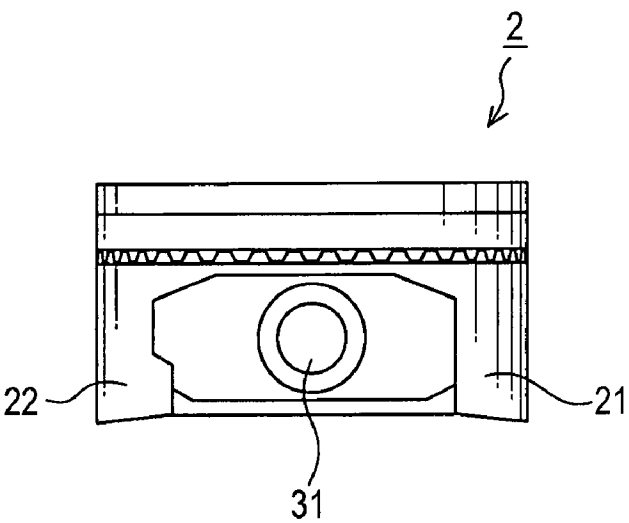
FIG. 9 is a front elevation of the piston as viewed from the same direction as in FIG. 1.
Figure 8:
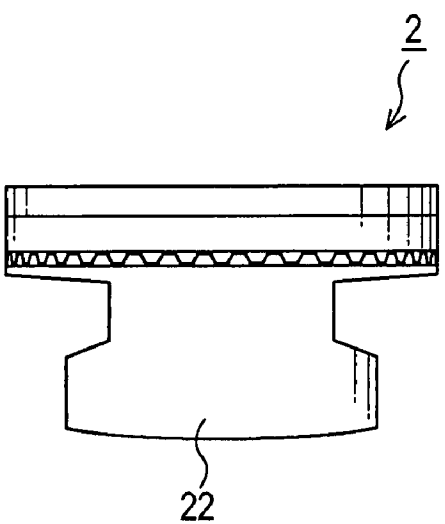
FIG. 8 is a side elevation of the piston as viewed from the left side of FIG. 1.

Referring to FIGS. 8 to 10, the piston 2 includes a piston skirt 21 and a piston skirt 22 in a front and back thereof. A piston skirt is not formed, however, on an extension of the piston pin 31. The counter weights 33C can pass-through both sides of the piston skirt 21, and do not interfere with the piston 2, when the piston 2 is in the vicinity of bottom dead center as shown in FIG. 13 because a piston skirt is not formed on the extension of the piston pin 31.

Furthermore, referring to FIGS. 6 and 7, a piston guide 14 that is an extension of the wall of the cylinder liner 1 is formed in the cylinder liner 1 between the lower link pass-through parts 12. The piston skirt 21 of the piston 2 slides on the piston guide 14 in the vicinity of bottom dead center as shown in FIG. 13. The piston 2 can move reciprocally with a stable posture in the vicinity of bottom dead center about the piston pin 31, without rocking, because the piston skirt 21 slides on the piston guide 14.

Referring to FIG. 7, the cutouts of the cylinder liner 1 are formed so as to become deeper from the piston guide 14 toward outer sides. By thus forming the cutouts so as to become deeper from the piston guide 14 toward the outer sides, lubricating oil flowing from above along the wall of the cylinder liner 1 collects in the piston guide 14, thus forming an oil film. The durability of the piston skirt 21, which slides on the piston guide 14, thus increases.

In this embodiment, the counter weight pass-through parts 11 and the lower link pass-through parts 12 are separated by a step, but desirable results in which an oil film is formed on the piston guide 14 may also be achieved by changing the height between the counter weight pass-through parts 11 and the lower link pass-through parts 12 using an incline instead of forming a step.

Referring to FIG. 3 and FIG. 11, the lower link 42, through which the first connecting pin 32 passes, travels through the lower link pass-through part 13. Accordingly, a piston guide like that of the right side wall of the cylinder liner 1 cannot be formed in the center of the lower link pass-through part 13.

Figure 12:
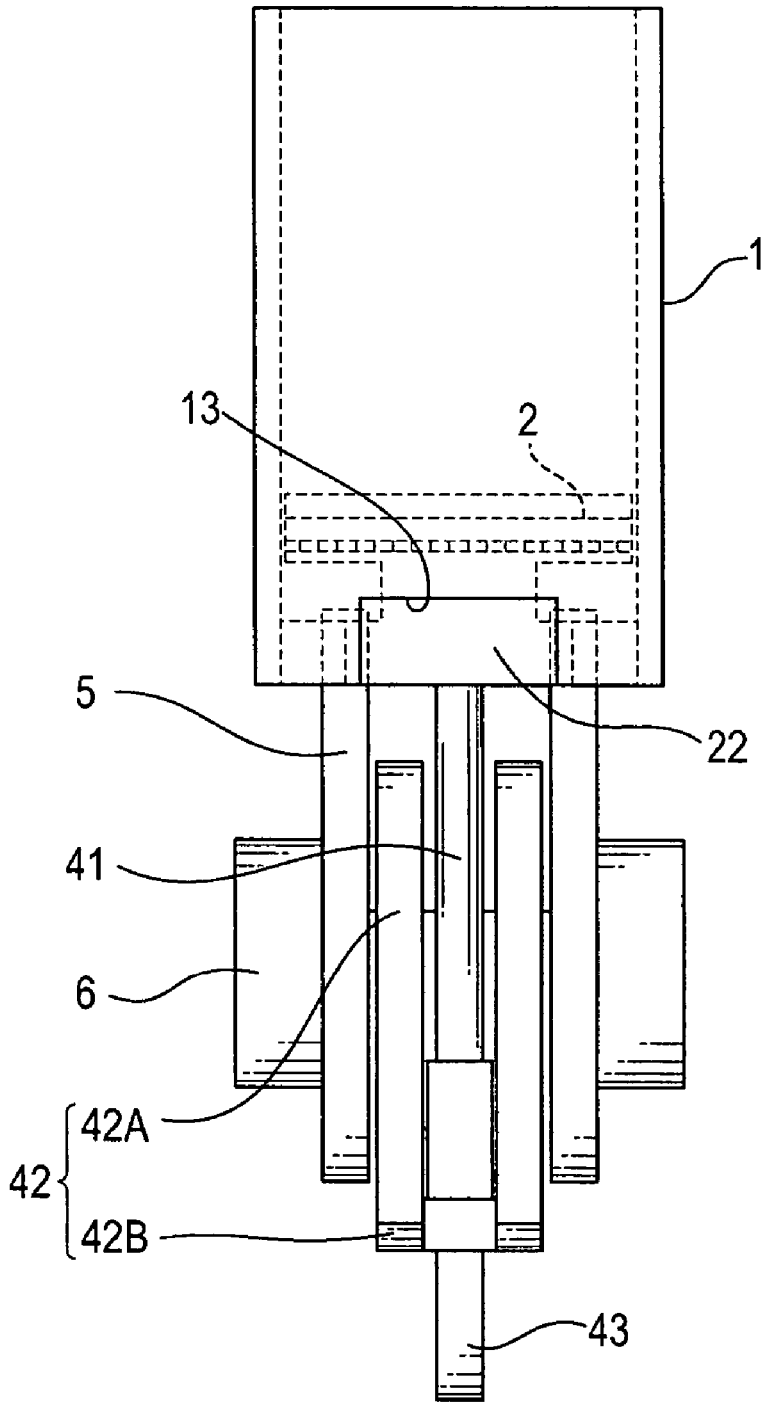
FIG. 12 is a side elevation of the piston and the related members as seen from the left side of FIG. 4.

Referring to FIG. 8, the circumference of the piston skirt 22 of the piston 2 is lengthened to be longer than the cutout length of the lower link pass-through part 13. Referring to FIG. 12, the piston skirt 22 of the piston 2 slides on the wall of the cylinder liner 1 on an outer side of the lower link pass-through part 13 when in the vicinity of bottom dead center. Accordingly, the piston 2 moves reciprocally with a stable posture, without rocking, about the piston pin 31.

According to this embodiment, a part of the right side wall of the cylinder liner 1 shown in FIG. 1 is cutout, forming the counter weight pass-through parts 11 and the lower link pass-through parts 12, and a part of the left side wall of the cylinder liner 1 shown in FIG. 1 is cutout, forming the lower link pass-through part 13. In addition, although the piston skirt 21 and the piston skirt 22 are formed in the front and the back of the piston 2, a piston skirt is not formed on an extension of the piston pin 31. Accordingly, the lower link 42 and the counter weights 33C do not interfere with the cylinder liner 1 or the piston 2, and the overall height of the engine can be reduced.

Furthermore, the cutouts formed in the cylinder liner 1 are formed so as to become deeper from the piston guide 14 toward outer sides. Accordingly, lubricating oil flowing from above collects in the piston guide 14. An oil film is formed by the lubricating oil thus collected, increasing the durability of the piston skirt 21.

Referring to FIGS. 14 to 18, a second embodiment of this invention will be explained next.

Figure 16:
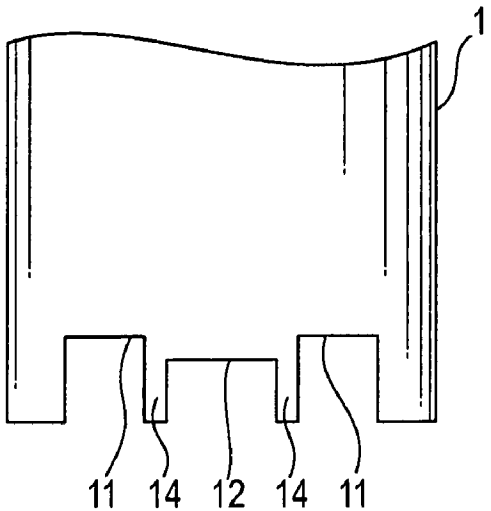
FIG. 16 is similar to FIG. 7, but shows the second embodiment of this invention.
Figure 15:
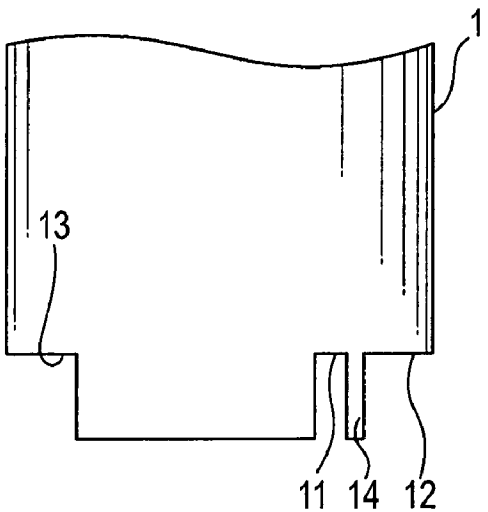
FIG. 15 is similar to FIG. 6, but shows the second embodiment of this invention.
Figure 14:
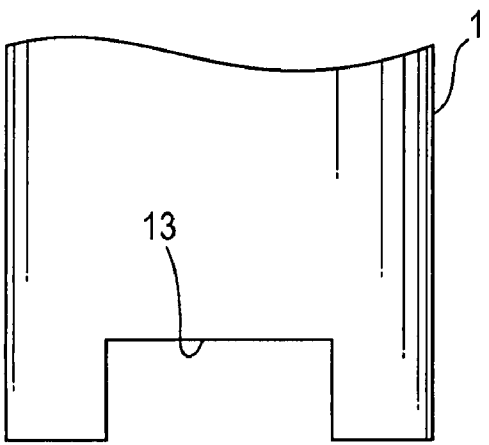
FIG. 14 is similar to FIG. 5, but shows a second embodiment of this invention.

FIGS. 14 to 16 correspond to FIGS. 5 to 7 of the first embodiment.

The second embodiment differs from the first embodiment in the shape of the cutouts of the cylinder liner 1, as shown in the figures. Other structures and configurations of the second embodiment are identical to those of the first embodiment.

Figure 17:
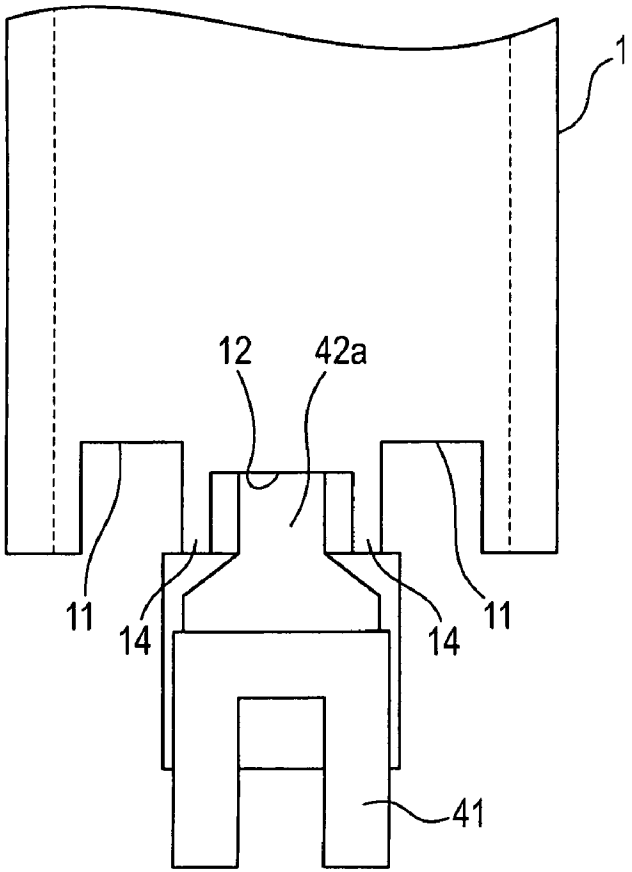
FIG. 17 is a diagram corresponding to FIG. 16, for explaining a relationship between a cylinder liner and a lower link at top dead center of a piston according to the second embodiment of this invention.

Referring to FIG. 17, a forward end of the upper link 41 is formed having two branches. The lower link 42 is connected to the two branches through the first connecting pin 32.

Referring to FIG. 16, the cylinder liner 1 includes the lower link pass-through part 12 where a rectangular shape is cutout from a center part of a lower end of the cylinder liner 1. Further, the counter weight pass-through parts 11 is also formed, similar to the first embodiment. Accordingly, referring to FIG. 17, the lower link 42 passes through the lower link pass-through part 12, and does not interfere with the cylinder liner 1, when the piston 2 is in the vicinity of top dead center.

Figure 18:
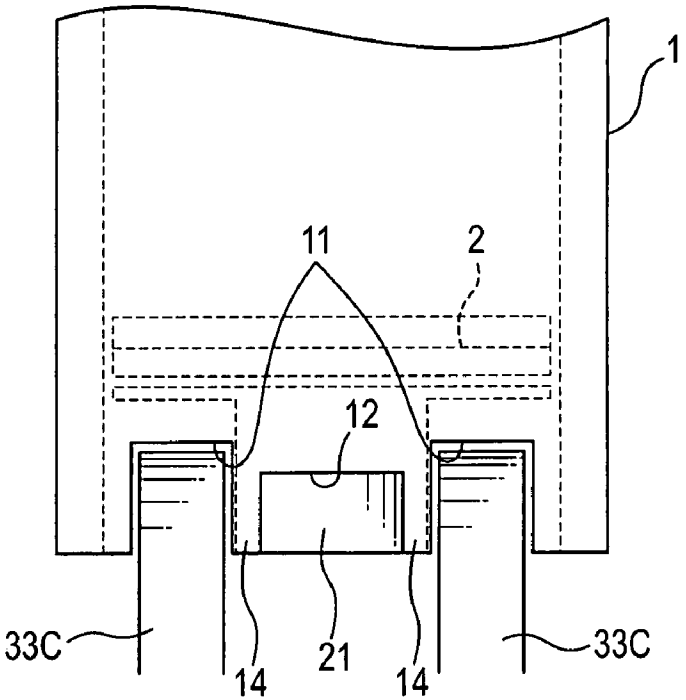
FIG. 18 is a diagram corresponding to FIG. 16, for explaining a relationship between the cylinder liner and the lower link at bottom dead center of the piston according to the second embodiment of this invention.

Furthermore, referring to FIG. 18, the counter weights 33C pass through the counter weight pass-through parts 11, and do not interfere with the cylinder liner 1, when the piston 2 is in the vicinity of bottom dead center.

The piston guides 14 are formed between the lower link pass-through part 12 and the counter weight pass-through parts 11 on both sides of the lower link pass through part 12. Referring to FIG. 18, in the vicinity of bottom dead center of the piston 2, the piston skirt 21 slides on the piston guide 14. Accordingly, in the vicinity of bottom dead center, the piston 2 moves reciprocally with a stable posture, without rocking, about the piston pin 31.

The overall height of the engine can be reduced according to this embodiment, similar to the first embodiment.

Although the invention has been described above by reference to certain embodiments of the invention, the invention is not limited to the embodiments described above. Modifications and variations of the embodiments described above will occur to those skilled in the art, within the scope of the Claims.

For example, although an engine type in which the cylinder liner 1 is inserted into a cylinder block is explained in the embodiments described above, it is also possible to apply the present invention to an engine that does not possess the cylinder liner 1. The counter weight pass-through part 11 and the lower link pass-through part 12 may be formed by directly cutting out a wall of a cylinder bore when the engine does not possess the cylinder liner 1.

Furthermore, although a multiple link engine in which the piston 2 is connected to the crankshaft 33 through the upper link 41 and the lower link 42 is explained in the embodiments described above, this invention may also be applied to a normal engine in which a piston is connected to a crankshaft through a connecting rod. Similar effects can be obtained provided that a part of a cylinder bore is cutout, forming a counter weight pass-through part. However, the overall height of the multiple link engines described above tends to increase due to its structure. A larger effect can therefore be obtained when applying the present invention to a multiple link engine compared to a normal engine.

The contents of Tokugan 2004-379447 with a filing date of Dec. 28, 2004 in Japan are hereby incorporated by reference.

The embodiments of this invention in which an exclusive property or privilege is claimed are defined as follows:

What is claimed is:

1. An internal combustion engine comprising:

a piston;

a crankshaft connected to the piston and comprising a journal as a rotation center, a crank pin located eccentrically with respect to the journal and rotating together with the journal, the piston being connected to the crankshaft via the crank pin, and a counter weight located eccentrically with respect to the journal in a direction opposite to the crank pin and rotating together with the journal; and a cylinder bore accommodating the piston such that the piston is free to reciprocate along a wall of the cylinder bore, the wall of the cylinder bore having a first cutout that allows a part of the counter weight to pass-through when the piston reciprocates in the cylinder bore.

2. The internal combustion engine as defined in claim 1, wherein the piston is connected to the crank pin via an upper link, and the piston comprises a piston pin which connects the piston with the upper link and a piston skirt which is formed on an outer circumference of the piston except a position located on the extension of the piston pin so as to slide on the wall of the cylinder bore.

3. The internal combustion engine as defined in claim 1, wherein the piston is connected to the crank pin via an upper link and a lower link, and wherein the wall of the cylinder bore further comprises a second cutout and a third cutout that each allow a part of the lower link to pass through.

4. The internal combustion engine as defined in claim 3, wherein the piston comprises a piston pin connected to the upper link, and a piston skirt which is formed on an outer circumference of the piston except a position located on the extension of the piston pin so as to slide on the wall of the cylinder bore.

5. The internal combustion engine as defined in claim 4, wherein a length of the piston skirt in a circumferential direction is set longer than a length of the third cutout in a circumferential direction.

6. The internal combustion engine as defined in claim 4, wherein the crankshaft comprises a pair of counter weights on both sides of the lower link, and wherein the wall of the cylinder bore comprises a pair of the first cutouts.

7. The internal combustion engine as defined in claim 6, wherein the second cutout is formed between the pair of the first cutouts of the wall of the cylinder bore.

8. The internal combustion engine as defined in claim 7, wherein the lower link comprises a two-branch member that branches in a U-shape, the upper link being connected to the lower link on an inner side of the two branch member, and wherein the wall of the cylinder bore comprises a pair of second cutouts formed corresponding to the two-branch member.

9. The internal combustion engine as defined in claim 8, wherein the wall of the cylinder bore further comprises a piston guide between the pair of second cutouts, the piston guide sliding on the piston skirt when the piston is in the bottom dead center position.

10. The internal combustion engine as defined in claim 3, wherein the first cutout is formed longer in an axial direction of the cylinder bore than the second cutout.

11. The internal combustion engine as defined in claim 7, wherein the wall of the cylinder bore comprises a piston guide between each of the pair of first cutouts and the second cutout, the piston guide sliding on the piston skirt when the piston is in the bottom dead center position.

* * * * *